United States Patent [19]

Eastlund et al.

[11] Patent Number: 4,712,155

[45] Date of Patent: Dec. 8, 1987

[54] METHOD AND APPARATUS FOR CREATING AN ARTIFICIAL ELECTRON CYCLOTRON HEATING REGION OF PLASMA

[75] Inventors: Bernard J. Eastlund, Spring, Tex.; Simon Ramo, Beverly Hills, Calif.

[73] Assignee: APTI, Inc., Los Angeles, Calif.

[21] Appl. No.: 695,517

[22] Filed: Jan. 28, 1985

[51] Int. Cl.[4] ..... H05B 6/64; H05C 3/00; H05H 1/46

[52] U.S. Cl. ..... 361/231; 89/1.11; 244/158 R; 380/59; 342/352

[58] Field of Search ..... 342/5, 351, 352, 460; 455/26; 361/230, 231; 244/158 R; 380/59; 89/1.11

[56] References Cited

U.S. PATENT DOCUMENTS

| | | | |
|---|---|---|---|
| 3,133,250 | 5/1964 | Molmud | 342/352 |
| 3,174,150 | 3/1965 | Sferrazza et al. | 342/352 |
| 3,174,705 | 5/1967 | Schiff et al. | 342/352 |
| 3,277,375 | 10/1966 | Nelson | 342/352 |
| 3,300,721 | 1/1967 | Seaton | 342/352 |
| 3,518,670 | 6/1970 | Miller | 342/5 |
| 4,035,726 | 7/1977 | Brice | 342/352 |

OTHER PUBLICATIONS

Liberty Magazine, Feb. 1935, Telsa, p. 7.
New York Times, 9/22/40, Section 2, p. 7, Laurence.
New York Time, 12/8/15, p. 8, col. 3.

*Primary Examiner*—Salvatore Cangialosi
*Attorney, Agent, or Firm*—Drude Faulconer

[57] ABSTRACT

A method and apparatus altering a region of plasma that lies above the earth's surface at altitudes (e.g. below 50 kilometer) where the collison rate of the electrons in the plasma is originally greater than the cyclotron frequency of the electrons. First, artificial magnetic lines of force are established from the earth's surface by positioning a loop of cable at the earth's surface. An electrical current of sufficient amperage is passed through the cable which inherently generates the artificial magnetic field from the center of the loop. The field strength B on the artificial lines in the region of plasma to be altered is sufficient to increase the cyclotron frequency of the electrons in the plasma so that it will exceed the rate of collosion of the electrons. The plasma is then excited by electron cyclotron resonance heating to thereby further alter the plasma by transmitting circularly polarized electromagnetic radiation upward in a direction substantially parallel to and along the artificial field lines.

11 Claims, 5 Drawing Figures

METHOD AND APPARATUS FOR CREATING AN ARTIFICIAL ELECTRON CYCLOTRON HEATING REGION OF PLASMA

DESCRIPTION

1. Technical Field

This invention relates to a method and apparatus for creating an artificial electric cyclotron resonance heating region of plasma and more particularly relates to creating artificial magnetic field lines from the earth's surface and then altering at least one region of plasma normally existing along said artificial lines at a selected altitude above the earth's surface.

2. Background Art

The earth's magnetic field is somewhat analogous to a dipole bar magnet. As such, the earth's magnetic field contains numerous divergent field or force lines, each line having ends which intersect the earth's surface at points on opposite sides of the Equator. The field lines which intersect the earth's surface near the poles have apexes which lie at the furthest points in the earth's magnetosphere while those closest to the Equator have apexes which reach only the lower portion of the magnetosphere.

Above the earth's surface, plasma is naturally present along these field lines. This plasma consists of equal numbers of positively and negatively charges particles (i.e., electrons and ions) which are guided by the field line. It is well established that a charged particle in a magnetic field gyrates about field lines, the center of gyration at any instance being called the "guiding center" of the particle. As the gyrating particle moves along a field line in a uniform field, it will follow a helical path about its guiding center, hence linear motion, and will remain on the field line. Electrons and ions both follow helical paths around a field line but rotate in opposite directions. The frequencies at which the electrons and ions rotate about the field line are called gyromagnetic frequencies or cyclotron frequencies because they are identical with the expression for the angular frequencies of gyration of particles in a cyclotron. The cyclotron frequency of ions in a given magnetic field is less than that of electrons, in inverse proportion to their masses.

While this plasma is present at lower altitudes, e.g. below 50 kilometers, the collision rate of the electrons in the plasma becomes much greater than the cyclotron frequency of the electrons at that altitude so an electron normally experiences one or more collisions with other electrons, ions, or particles before it can complete one path around its field line. These collisions cause the electrons to continuously change course preventing the electrons from following their normal helical pathes around the field line.

At higher altitudes, the cyclotron frequency of the electrons exceed the collision rate between electrons so particular electrons may continue to follow defined helical pathes around a particular field line for prolonged periods, especially if the electrons are at a sufficient altitude and energy level to become trapped on the field line between mirror points there thereon. When the flow of electrons is relatively coherent or constant for at least a complete helical path about a field line, energy may be inputted from the earth along the field line to add energy to the electrons to substantially alter the plasma of which the electrons form a part thereof. For a more complete discussion of how earth-generated energy is transmitted to substantially alter a region of plasma, see copending U.S. Patent Application Ser. Nos. 690,333 and 690,354, both, filed Jan. 10, 1985.

In the above-mentioned applications, energy is added to the plasma by transmitting electromagnetic radiation to establish electron cyclotron resonance heating in a region of plasma which lies at an altitude where the cyclotron frequency is greater than the collision rate of the electrons in the plasma. Increasing the energy of electrons by electron cyclotron resonance heating, is based on a principle similar to that involved in accelerating charged particles in a cyclotron. That is, by passage of a radiofrequency current through a coil which is concentric with that producing the axial field, then in each half-cycle of their rotation about the field lines, the charged particles, e.g. electrons, acquire energy from the oscillating electric field associated with the radio frequency.

The use of electron cyclotron resonance heating to add energy to the electrons of a plasma has heretofore been restricted to regions of plasma which lie at altitudes where the cyclotron frequency exceeds the collision rate of the electrons, (e.g. ionosphere and higher). However, since many benefits (e.g. long distance communications, weather modification, etc.) may arise from being able to alter plasma regions at lower altitudes a need exists for being able to excite electron cyclotron resonant heating in regions of plasma at lower altitudes where the collision rate of the electrons is originally greater that the cyclotron frequency of the electrons.

DISCLOSURE OF THE INVENTION

The present invention provides a method and apparatus for creating an artificial electron cyclotron heating region of plasma that lies above the earth's surface at altitudes (e.g. below 50 kilometers) where the collision rate of the electrons in the plasma is orginally greater than the cyclotron frequency of the electrons. First, artificial magnetic lines of force are established from the earth's surface into the region in which the operation is to be carried out.

To establish the artificial magnetic field lines, a loop of cable is positioned at the earth's surface so that the center of the loop will be colinear with the desired artificial field lines. An electrical current of sufficient amperage is passed through the cable which inherently generates a dipole field, with the central field line thereof extending outward from the plane of the loop. The artificial magnetic field is designed so that the field strength B at the altitude of the region of plasma to be altered is sufficient to increase the cyclotron frequency of the electrons in the plasma so that it will exceed the collision rate of the electrons. When this occurs, the plasma is now in condition to be excited by electron cyclotron resonance heating to thereby increase the charged particle energy. This is done by transmitting circularly polarized electromagnetic radiation from the earth's surface at or near one end of a artificial magnetic field line where it intersects the earth's surface. Right hand circular polarization is used in the northern hemisphere and left hand circular polarization is used in the southern hemisphere. The radiation is deliberately transmitted at the outset in a direction substantially parallel to and along the artificial field line which extends upwardly through the region of plasma to be altered. The radiation is transmitted at a frequency which is based on the cyclotron or gyrofrequency of the charged particles and which, when applied to the plasma is said at least one region, excites electron cyclotron resonance within the plasma to heat and accelerate the charged particles in their respective helical paths around and along the field line. Sufficient energy may be employed to cause ionization of neutral particles (molecules of oxygen, nitrogen and the like, particulates, etc.) which then become a part of the plasma thereby increasing the charged particle density of the plasma.

In one embodiment of the invention, electron cyclotron resonance heating is carried out in the selected region at sufficient power levels to allow the plasma to generate a mirror force which forces the charged electrons of the altered plasma upward along the force line to an altitude which is higher than the original altitude. As the plasma moves upward, other particles from the atmosphere at the same altitude as the selected region move horizontally into the region to replace the rising plasma and to form new plasma. The kinetic energy developed by said other particles as they move horizontally is on the same order of magnitude of as the total zonal kinetic energy of stratospheric winds known to exist at altitudes equal to the region being altered. Since there is evidence that these stratospheric winds may be linked to certain weather patterns on earth, the present method may be used to affect similar patterns.

In another embodiment, the present method is used to alter at least one selected region of plasma in the stratosphere to establish a defined layer of plasma having an increased charged particle density. Once this layer is established and while maintaining the transmission of the main beam of circularly polarized electromagnetic radiation, the main beam is modulated and/or at least one second different, modulated electromagnetic radiation beam is transmitted from at least one separate source at a different frequency which will be absorbed in the plasma layer. The amplitude of the frequency of the main beam and/or the second beam or beams is modulated in resonance with at least one known oscillation mode in the selected region or regions to excite the known oscillation mode to propagate a known frequency wave or waves throughout the stratosphere which may be used in communications.

BRIEF DESCRIPTION OF THE DRAWINGS

The actual construction, operation, and apparent advantages of the present invention will be better understood by referring to the drawings in which like numerals identify like parts and in which.

BEST MODES FOR CARRYING OUT THE INVENTION

Figure 1:
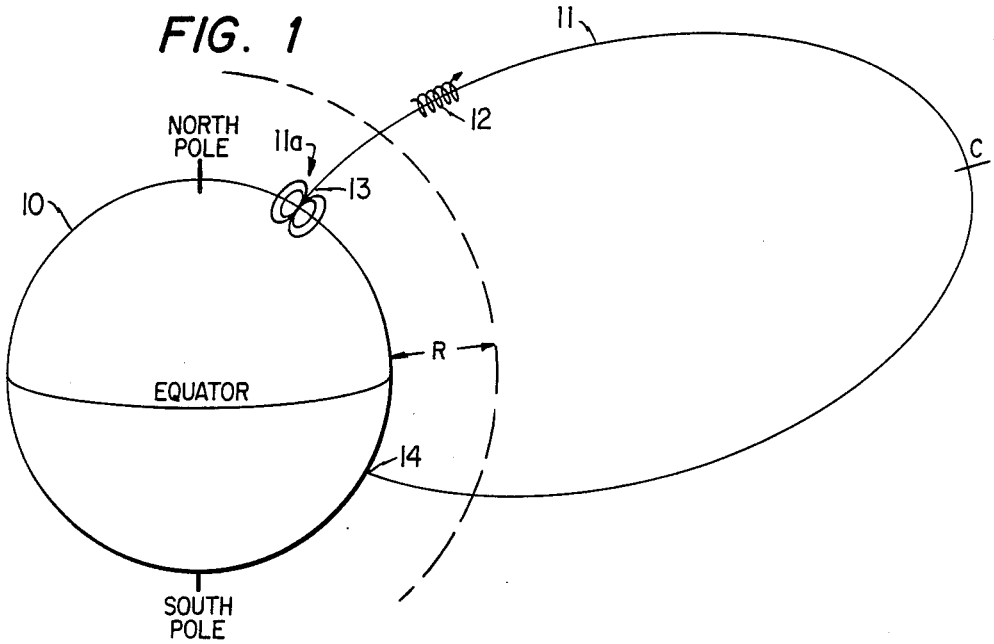
FIG. 1 is a simplified schematical view of the earth (not to scale) with a naturally occurring magnetic field (force) line having an artificial magnetic field thereon in accordance with the present invention.

Referring now more particularly to the drawings, FIG. 1 is a simplified illustration of the earth 10 and one of its naturally occuring dipole magnetic field lines 11.

As will be understood, line 11 may be any one of the numerous naturally existing field lines and the actual geopraphical location, at which the ends 13 and 14 of line 11 intersect the earth's surface is documented and is readily ascertainable by those skilled in the art. Plasma 12 is naturally present along these field lines. This plasma consists of equal numbers of positively and negatively charged particles (i.e., electrons and ions) which are guided by the field line 11.

It is well established that a charged particle in a magnetic field will gryrate about field lines unless it collides with another particle. As the gryrating particle moves along a field line in a uniform field, it will follow a helical path about its guiding center, hence linear motion, and will remain on the field line. Electrons and ions both follow helical paths around a field line but rotate in opposite directions. The frequencies at which the electrons and ions rotate about the field line are called gyromagnetic frequencies or cyclotron frequencies because they are identical with the expression for the angular frequencies of gyration of particles in a cyclotron. The cyclotron frequency of ions in a given magnetic field is less than that of electrons, in inverse proportion to their masses.

As shown in FIG.1, the electrons in plasma 12 which lie at or above an altitude, e.g. at least about 66 kilometers, where the cyclotron frequency of the electrons are greater than the collision rate of the electrons will, in fact, follow helical paths around line 11. However, in region R, which includes those altitudes (e.g. less than about 50 kilometers) at which the collision rate of electrons exceed the cyclotron frequency of the electrons, individual electrons (not shown) will collide with other particles before they complete a helical path around line 11 and will be deflected therefrom. The charged particles which form plasma in region R move between collisions with other particles along similar helical paths around the field lines and although a particular particle may diffuse downward into the earth's lower atmosphere or lose energy and diverge from its original field line due to collisions with other particles, these charged particles are normally replaced by other available charged particles or by particles that are ionized by collision with said particle. The electron density ($N_e$) of the plasma will vary with the actual conditions and locations involved. Also, neutral particles, ions, and electrons are present in proximity to the field lines.

As known in plasma physics, the characteristics of a plasma can be altered by adding energy to the charged particles or by ionizing or exciting additional particles to increase the density of the plasma. One way to do this is by heating the plasma which can be accomplished in different ways, e.g., ohmic, magnetic compression, shock waves, magnetic pumping, electron cyclotron resonance, and the like.

Since electron cyclotron resonance heating is involved in the present invention, a brief discussion of same is in order. Increasing the energy of electrons in a plasma by invoking electron cyclotron resonance heating, is based on a principle similar to that utilized to accelerate charged particles in a cyclotron. If a plasma is confined by a static axial magnetic field of strength B, the charged particles will gyrate about the lines of force with a frequency given, in hertz, as $f_g = 1.54 \times 10^3$ B/A, where: B = magnetic field strength in gauss, and A = mass number of the ion.

Suppose a time-varying field of this frequency is superimposed on the static field B confining the plasma, by passage of a radiofrequency current through a coil which is concentric with that producing the axial field, then in each half-cycle of their rotation about the field lines, the charged particles acquire energy from the oscillating electric field associated with the radio frequency. For example, if B is 10,000 gauss, the frequency of the field which is in resonance with protons in a plasma is 15.4 megahertz.

As applied to electrons, electron cyclotron resonance heating requires an oscillating field having a definite frequency determined by the strength of the confining field. The radiofrequency radiation produces time-varying fields (electric and magnetic), and the electric field accelerates the charged particle. The energized electrons share their energy with ions and neutrals by undergoing collisions with these particles, thereby effectively raising the temperature of the electrons, ions, and neutrals. The apportionment of energy among these species is determined by collision frequencies. For a more detailed understanding of the physics involved, see "Controlled Thermonuclear Reactions", Glasstone and Lovberg, D. Van Nostrand Company, Inc., Princeton, N.J., 1960 and "The Radiation Belt and Magnetosphere", Hess, Blaisdell Publishing Company, 1968.

However, before electron cyclotron resonant heating can be excited in the plasma of region R, the cyclotron frequency of the electrons therein has to be increased until it is greater than the collision rate of the electrons. This is accomplished in the present invention by establishing an artificial dipole magnet field 11*a* within region R which has sufficient field strength B to increase the cyclotron frequency of electrons 12*a* (FIG. 3) at the attitude of interest until it exceeds the collosion rate of the electrons at that attitude.

Figure 2:
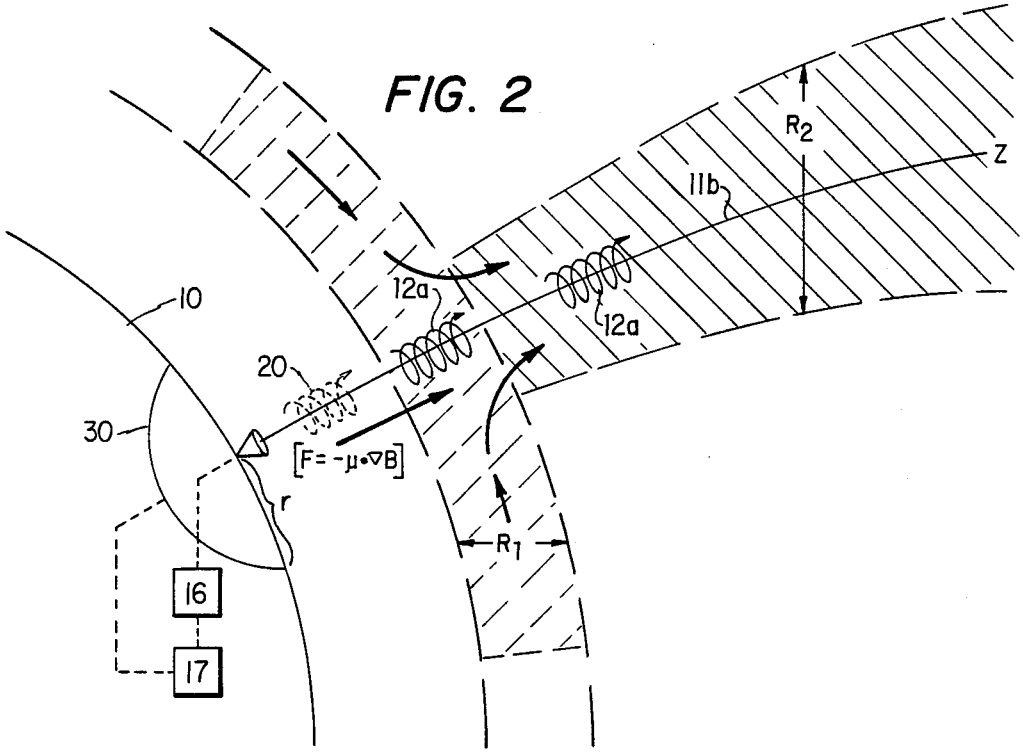
FIG. 2 is one embodiment within the present invention in which a selected region of plasma is raised to a higher altitude to thereby induce horizontal flow in said region.
Figure 3:
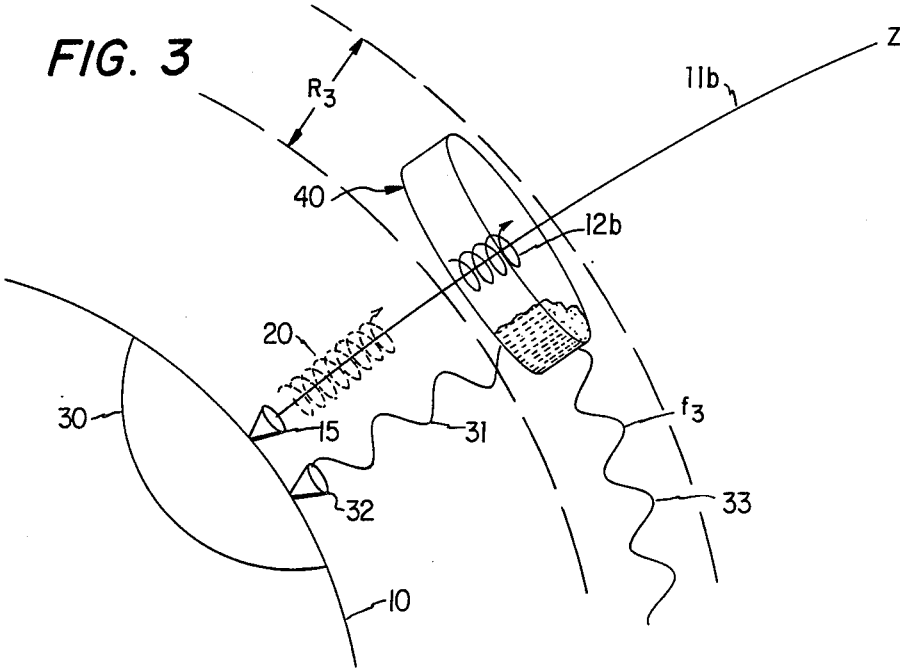
FIG. 3 is a schematic view of another embodiment within the present invention.
Figure 4:
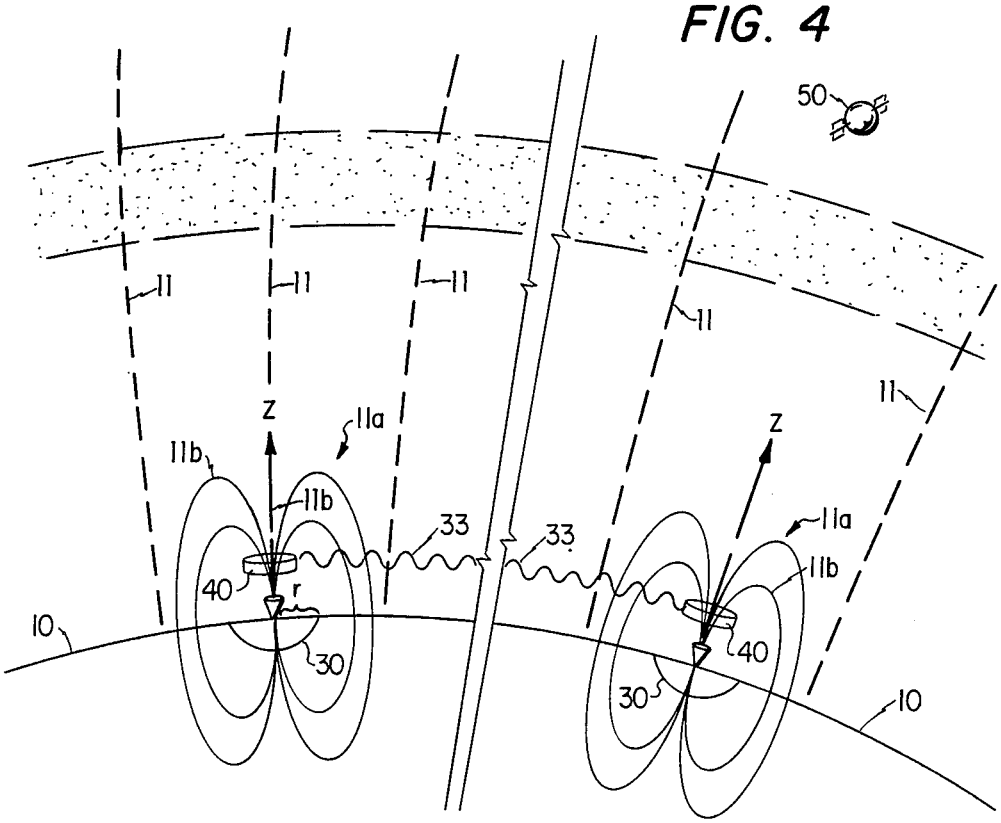
FIG. 4 is a schematic view of still a further embodiment within the present invention.

A preferred means to establish artificial magnetic field 11*a* is shown in FIGS. 2, 3 and 4. A circular loop 30 (only half is shown) of an electrically-conductive cable is positioned at the earth's surface 10 at a location at which the artificial magnetic line 11*b* is to intersect the earth's surface. Loop 30 maybe positioned on an incline, e.g. mountain so that artificial line 11*b* will be projected outwardly at an angle respective to horizontal at the earth's surface and also with respect to naturally-occurring magnetic line 11. Electrical current at high amperage is supplied to loop 30 and flowed therethrough which then establishes artificial line 11*b* which extends outward from the center of loop 30.

The following is a typical example of an artificial magnetic line 11*b* which is to established in accordance with the present invention. A location is selected in the State of Alaska in an area commonly referred to as the North Slope. Plasma in region R at an altitude of about 35 kilometers is to be altered. The field strength B which is typical at this altitude along the naturally - occurring field line in this area is approximately 0.62 gauss. This strength B at this altitude is such that the collision rate of the electrons (FIG. 3) is greater than their cyclotron frequency and must be increased (for example, by 10 fold) to insure the cyclotron frequency becomes greater than the collision rate. The following known relationship for magnetic induction on the center line of a circular turn where the distance in the Z direction (i.e. altitude of R.) is equal to the radius r of loop 30 can be used to properly dimension loop 30 and determine the necessary amperage:

$$B = \frac{\mu_o I r^2}{2(2r^2)}$$

wherein:

B = Desired field strength at 100 kilometer = $1.1 \times 10^{-3}$ webers/sq. meters $\mu = 4\pi \times 10^{-7}$ I = current in amps r = radius of loop in meter Substituting known values (i.e. radius of loop 30 is approximately equal to the altitude or 100 kilometers in this example), the above equation is solved to establish that $5 \times 10^8$ amperes of current will need to be flowed through loop 30 having a radius of 100 kilometers to produce an artificial field line 11*b* which has a field strength of $1.1 \times 10^{-3}$ webers/sq. meters. To transmit this current will require a superconducting cable having about a one-meter diameter and is within the art of superconducting power transmission, see Electrical Characteristics of a Superconducting Cable; Chowder, CRYOGENICS; April, 1982.

Once artificial magnetic line 11*b* is established, the cyclotron frequency of the charged particles in plasma 12*a* in region $R_1$ will now be greater than the collision rate which permits the charged particles of plasma 12*a* to follow helical paths around line 11*b* so that it can now be altered further by exciting electron cyclotron resonance heating in plasma 12*a* to add energy to the charged particles or by exciting or ionizing additional particles to increase the density of the plasma.

To do this, antenna 15 is positioned as close as is practical to the center of loop 30. Antenna 15 may be of any known construction for high directionality, for example, a phased array, beam spread angle (O) type. See "The MST Radar at Poker Flat, Alaska", Radio Science, Vol. 15, No. 2, March-April 1980, pps. 213-223, which is incorporated herein by reference. Antenna 15 is coupled to transmitter 16 which generates a beam of high frequency electromagnetic radiation at a wide range of discrete frequencies, e.g., from about 10 kilohertz to about 30 gigahertz.

Transmitter 16 as well as loop 30 is powered by power generator means 17 which is preferably comprised of one or more large, commercial electrical generators. Some embodiments of the present invention require large amounts of power, e.g., up to $10^9$ to $10^{11}$ watts, in continuous wave or pulsed power. Generation of the needed power is within the state of the art. Although the electrical generators necessary for the practice of the invention can be powered in any known manner, for example, by nuclear reactors, hydroelectric facilities, hydrocarbon fuels, and the like, this invention, because of its very large power requirement in certain applications, is particularly adapted for use with certain types of fuel sources which naturally occur at strategic geographical locations around the earth. For example, large reserves of hydrocarbons (oil and natural gas) exist in Alaska and Canada. In northern Alaska, particularly the North Slope region, large reserves are currently readily available. Alaska and northern Canada also are ideally located geographically as to magnetic latitudes. Thus, in Alaska, there is a unique combination of large, accessible fuel sources at desirable field line intersections. Further, a particularly desirable fuel source for the generation of very large amounts of electricity is present in Alaska in abundance, this source being natural gas. The presence of very large amounts of clean-burning natural gas in Alaskan latitudes, particularly on the North Slope, and the availability of magnetohydrodynamic electric generators which operate very efficiently with natural gas provides an ideal power source for the unprecedented power requirements of certain of the applications of this invention.

Referring now to FIG. 3, a first embodiment of how plasma 12*a* is altered is illustrated where a selected region $R_1$ of plasma 12*a* is altered by electron cyclotron resonance heating to accelerate the electrons of plasma 12, which are following helical paths along artificial field line 11*b* which has been established as explained above.

To accomplish this result, electromagnetic radiation is transmitted at the outset, essentially parallel to artificial field line 11*b* via antenna 15 as right hand circularly polarized radiation wave 20. Wave 20 has a frequency which will excite electron cyclotron resonance with plasma 12 at its initial or original altitude. This frequency will vary depending on the electron cyclotron resonance of region $R_1$ which, in turn, can be determined from available data based on the altitude of region $R_1$, the strength B of the on artficial magnetic field 11*b* at said altitude, etc. Frequencies of from about 10 kilohertz to about 30 gigahertz can be employed. Also, for any given application, there will be a threshhold (minimum power level) which is needed to produce the desired result. The minimum power level is a function of the level of plasma production and movement required, taking into consideration any loss processes that may be dominant in a particular plasma or propagation path.

As electron cyclotron resonance is established in plasma 12*a*, energy is transferred from the electromagnetic radiation 20 into plasma 12*a* to heat and accelerate the electrons therein and, subsequently, ions and neutral particles. As this process continues, neutral particles which are present within $R_1$ are ionized and absorbed into plasma 12*a* and this increases the electron and ion densities of plasma 12*a*. As the electron energy is raised to values of about 1 kilo electron volt (kev), the generated mirror force (explained below) will direct the excited plasma 12 upward along line 11*a* in the form of plume $R_2$ at an altitude higher than that of $R_1$.

Plasma acceleration results from the force on an electron produced by a nonuniform static magnetic field (B). The force, called the mirror force, is given by $$\bar{F} = = -\mu \nabla \bar{B}$$

where $\mu$ is the electron magnetic moment and $\nabla\bar{B}$ is the gradient of the magnetic field, being further defined as:

$$W\perp/B = mV\perp^2/2B$$

where $W\perp$ is the kinetic energy in the direction perpendicular to that of the magnetic field lines and B is the magnetic field strength at the line of force on which the guiding center of the particle is located. The force as represented by equation (2) is the force which is responsible for a particle obeying equation (1).

Since the magnetic field is divergent in region $R_1$, it can be shown that the plasma will move upwardly from the heating region as shown in FIG. 1 and further it can be shown that $$\tfrac{1}{2}M_eV_e\perp^2(x) \simeq \tfrac{1}{2}M_eV_e\perp^2(Y) + \tfrac{1}{2}M_iV_{iII}^2(Y) \quad (3)$$

where the left hand side is the initial electron transverse kinetic energy; the first term on the right is the transverse electron kinetic energy at some point (Y) in the expanded field region, while the final term is the ion kinetic energy parallel to B at point (Y). This last term is what constitutes the desired ion flow. It is produced by an electrostatic field set up by electrons which are accelerated according to Equation (2) in the divergent field region and pulls ions along with them. Equation (3) ignores electron kinetic energy parallel to B because $V_{eII}{}^{\circ}V_{iII}$, so the bulk of parallel kinetic energy resides in the ions because of their greater masses. For example, if an electromagnetic energy flux of from about 1 to about 10 watts per square centimeter is applied to region R, whose altitude is 100 km, a plasma having a density ($N_e$) $10^{13}$ per cubic centimeter will be generated and moved upward with a verticle component of kinetic energy equal to $10^7$ ergs/cm$^2$. The movement of electrons in the plasma is due to the mirror force while the ions are moved by ambipolar diffusion. This effectively "lifts" a layer of plasma 12*a* from region $R_1$ to a higher elevation $R_2$.

The electrons are accelerated to velocities required to generate the necessary mirror force to cause their upward movement. At the same time neutral particles which are present along line 11*a* in region $R_1$ are ionized and become part of plasma 12*a*. As electrons move upward along line 11*a*, they drag ions and neutrals with them. Also, any particulates that may be present in region $R_1$, will be swept upwardly with the plasma. As the charged particles of plasma 12*a* move upward, other particles such as neutrals within $R_1$, move horizontally in to replace the upwardly moving particles. As plasma 12*a* is being moved upward with a very high kinetic energy in the vertical direction (e.g. $10^7$ ergs/cm$^2$), the flow of the atmosphere particles to replace the rising plasma will have comparable kinetic energy in the horizontal direction. The horizontal kinetic energy so generated will be of the same order of magnitude as the total zonal kinetic energy of naturally-occurring stratospheric wind at altitudes of 22 to 32 kilometer; see "The Energetics of the Stratosphere during the Winter Warmings of 1970/71 and 1974/75;" E. Klinker, COSPAR SPACE RESEARCH, Vol. XVii, Pergamon Press, 1977. Since there is evidence that wind currents in the stratosphere appear to be linked to certain weather patterns on earth, such winds can be produced with the present invention at selected locations and altitudes which can be used in establishing such weather patterns.

FIG. 3 illustrates another embodiment wherein a selected region R of plasma 12*a* at a low altitude to increase the density thereof whereby a relatively stable layer 40 of relatively dense plasma is maintained within region $R_3$. First artificial magnetic line 11*b* is established as disclosed above. Electromagnetic radiation is then transmitted at the outset essentially parallel to field 11*b* via antenna 15 as a right hand circularly polarized wave and at a frequency (e.g., 178 megahertz when the magnetic field at the desired altitude is $1.1\times10^{-3}$ webers/sq. meter) capable of exciting electron cyclotron resonance in plasma 12*b* in Region $R_3$. This causes heating of the particles (electrons, ions, neutrals, and particulates) and ionization of the uncharged particles adjacent line 11*b*, all of which are absorbed into plasma 12*b* to increase the density thereof. The power transmitted, e.g., $10^{-5}$ watts $-cm^2$ for up to 10 minutes heating time, is less than that required to generate the mirror force F required to move plasma 12*b* upward as in the previous embodiment.

While continuing to transmit electromagnetic radiation 20 from antenna 15, a second electromagnetic radiation beam 31, which is at a defined frequency different from the radiation from antenna 15, is transmitted from one or more second sources via antenna 32 into layer 40 and is absorbed into a portion of layer 40 (cross-hatched area in FIG. 4). The electromagnetic radiation wave from antenna 32 is amplitude modulated to match a known mode of oscillation $f_3$ in layer 30. This creates a resonance in layer 30 which excites a new plasma wave 33 which also has a frequency of $f_3$ and which then propogates through region R. Wave 33 can be used to improve or disrupt communications or both depending on what is desired in a particular application. Of course, more than one new wave 33 can be generated and the various new waves can be modulated at will and in a highly nonlinear fashion.

FIG. 4 illustrates still a further embodiment of the present invention wherein more than one artificial magnetic field 11*a* is established at points spaced from each other on the earth's surface 10. Each magnetic field 11*a* is established as described in connection with FIG. 3 above and a stable layer 40 of relatively dense plasma is maintained on magnetic field line 11*b* of each field at approximately the same attitudes. A plasma wave 33 is excited as described above and propogates between the spaced layers 40 and can be used to enhance communications between the points at which the artificial magnetic fields are located and at points therebetween. That is, a communication signal can be transmitted onto wave 33 at any point along wave 33 and will be carried thereby throughout the wavepath. This signal can be retrieved by receivers (not shown) spaced at points on the earth's surface below the wavepath. This modification is particularly useful in establishing communications between points on the earth when communications via orbiting satellite 50 may become blocked by a dense layer D of high intensity, trapped charged particles at higher altitudes. Layers D of such particles have been shown to be possible as a result of the denotation of nuclear devices at such altitudes or the like.

Figure 5:
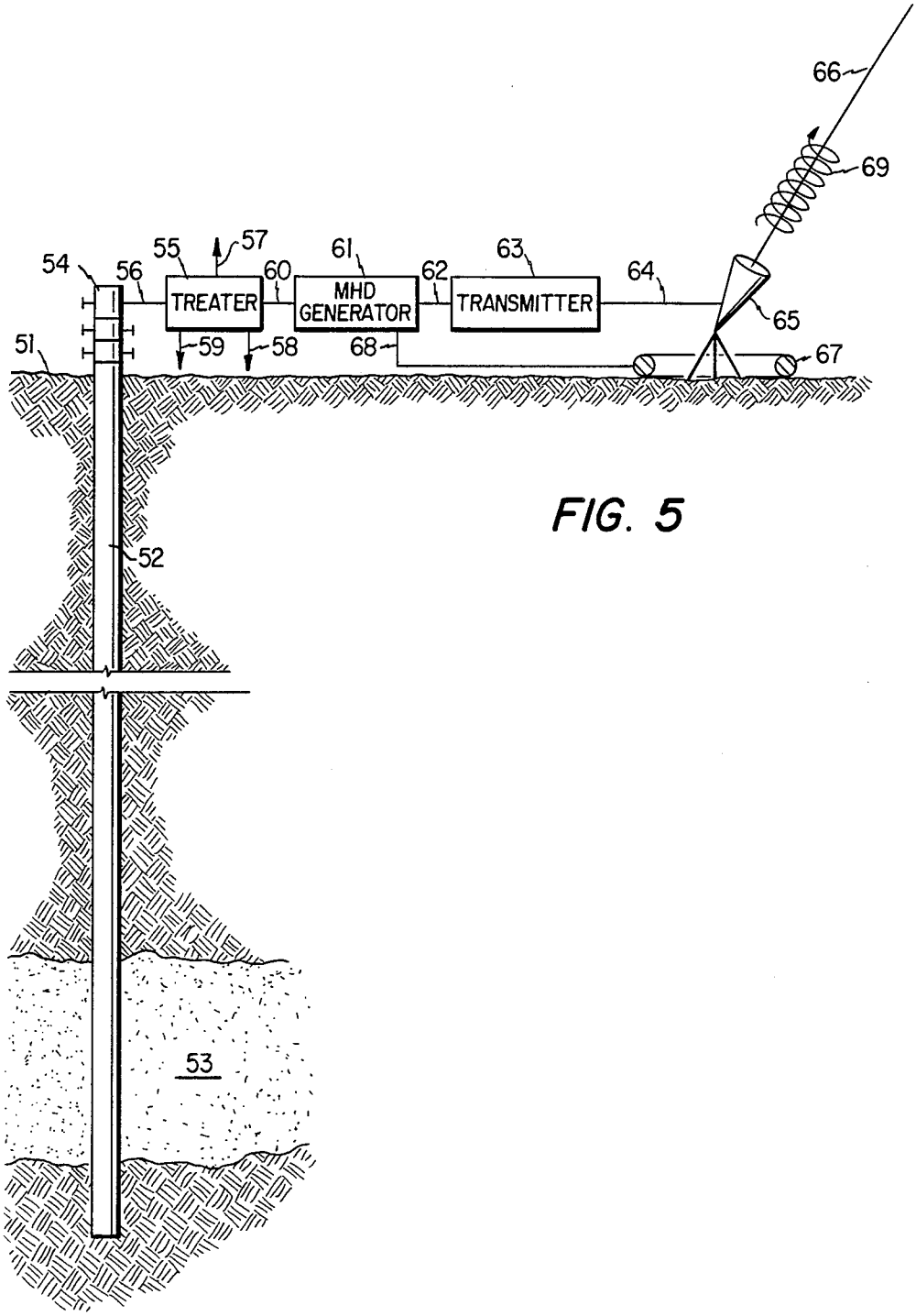
FIG. 5 is a schematic vien of apparatus within the present invention.

FIG. 5 shows apparatus useful in this invention. In FIG. 5 there is shown the earth's surface 51 with a well 52 extending downwardly thereinto until it penetrates hydrocarbon producing reservoir 53. Hydrocarbon reservoir 53 produces natural gas alone or in combination with crude oil. Hydrocarbons are produced from reservoir 53 through well 52 and wellhead 54 to a treating system 55 by way of pipe 56. In treater 55 desirable liquids such as crude oil and gas condensates are separated and recovered by way of pipe 57 while undesirable gases and liquids such as water, $H_2S$, and the like are separated by way of pipe 58. Desirable gases such as carbon dioxide are separated by way of pipe 59, and the remaining natural gas stream is removed from treater 55 by way of pipe 60 for storage in conventional tankage means (not shown) for future use and/or use in an electrical generator 61 such as a magnetohydrodynamic, gas turbine, fuel cell or EGD generator. Any desired number and combination of different types of electric generators can be employed in the practice of this invention.

The natural gas is burned in generator 61 to produce substantial quantities of electricity which is then stored and/or passed by way of wire 62 to a transmitter 63 which generates the electromagnetic radiation to be used in the method of this invention. The electromagnetic radiation is then passed by way of wire 64 to antenna 65 which is located at or near the end of artificial field line 66. Artificial field line 66 is generated by electromagnetic coil 67 which is powered by way of wire 68 from generator 61. Antenna 65 sends circularly polarized radiation wave 69 upwards along artificial field line 66 to carry out the various methods of this invention as described hereinabove.

The fuel source need not be used in its naturally-occurring state but could first be converted to another second energy source form such as hydrogen, hydrazine and the like, and electricity then generated from said second energy source form.

It can be seen from the foregoing that an artificial magnetic field line can be established at or near a large naturally-occurring hydrocarbon source and exceedingly large amounts of power can be very efficiently produced and used to generate magnetic field lines and to transmit radiation along said field lines. This is particularly so when the fuel source is natural gas and magnetohydrodynamic generators are employed.

Only one set of equipment is shown in FIG. 5 for sake of simplicity. For a large hydrocarbon reservoir 53, a plurality of wells 52 can be employed to feed one or more storage means and/or treaters 55 and as large a number of generators 61 as needed to power one or more transmitters 63, antennas 65, and coils 67. Since all of the apparatus 55 through 68 can be employed and used essentially at the site where naturally-occurring fuel source 53 is located, all the necessary artificial field lines 66 and electromagnetic radiation 69 is generated essentially at the same location as fuel source 53. This provides for a maximum amount of usable energy since there are no significant storage or transportation losses to be incurred.

It can be seen from the foregoing that this invention can be applied to any artificial magnetic field or fields wherever located and whether uniform or nonuniform in nature. This invention can be employed in any region of the atmosphere or space where an artificial magnetic field or fields can be generated after which the electron cyclotron resonance heating is carried out as described herein. Thus, this invention can be practiced with a very small localized uniform or irregular magnetic field or with a much larger artificial magnetic field such as those approaching the size and uniformity of naturally-occuring magnetic fields. Although it may not be practical in some cases to employ an artificial magnetic field approaching the size of the earth's natural magnetic field, this invention can be employed to augment, complement or otherwise utilize or improve upon such naturally-occurring fields.

Accordingly, this invention could be employed in a method for altering at least one region normally existing above the earth's surface with electromagnetic radiation using artificially generated and diverging magnetic field lines comprising generating the artificial field line or lines, transmitting first electromagnetic radiation from the earth's surface, said transmitting being conducted substantially parallel to and along at least one of said artificial field lines, adjusting the frequency of this first radiation to a value which will excite electron cyclotron resonance at an initial elevation above the earth's surface, whereby in the region in which the electron cyclotron resonance takes place, heating, further ionization, and movement of both charged and neutral particles is effected. In this process, artificial particles can be added to the region which is excited by the electron cyclotron resonance in any manner such as from a rocket or an orbiting satellite. In this method, sufficient electromagnetic radiation can be transmitted so that an altered plasma in the region is trapped on the artificial field line or lines between mirror points and oscillates back and forth therebetween. If the electron cyclotron resonance excited region is energized sufficiently to cause a rising plasma region, this rising region can pull with it a substantial portion of neutral particles which exist in or near the plasma region. In this method, the electron cyclotron excitation of the region can be continued until the electron concentration of the region reaches a value of at least $10^6$ per cubic centimeter.

The method of this invention can also be employed for altering at least one selected region normally existing above the earth's surface by employing electromagnetic radiation along at least one artificially generated magnetic field line to excite electron cyclotron resonance in the region and wherein the electromagnetic radiation is generated at the site of a naturally-occurring hydrocarbon fuel source, said fuel source being located in at least one of northerly or southerly magnetic latitudes. In this method, the fuel source can be a hydrocarbon such as natural gas and electricity for generating the electromagnetic radiation is obtained by burning the hydrocarbon fueld in at least one of magnetohydrodynamic, gas turbine, fuel cell, and EGD electric generators located at the site where the hydrocarbon fuel source naturally occurs in the earth. The hydrocarbon fuel source can be located anywhere in the world such as within the natural magnetic latitutdes that encompass Alaska.

This invention also encompasses apparatus for altering at least one region normally existing above the earth's surface with electromagnetic radiation comprising a combination of a naturally-occurring fuel source, means for making the fuel source available for use, means for exploiting the fuel source to generate electricity, means for converting the generated electricity into electromagnetic radiation of a desired frequency, means for generating at least one artificial magnetic field line, and means for transmitting the electromagnetic radiation along the artificial magnetic field line. The apparatus can be employed so that the artificially generated magnetic field line intersects the earth's surface at or near the naturally-occurring fuel source. The naturally-occurring fuel source could be produced from the earth, treated for the removal of undesirable fluids and burned to generate electricity essentially at the iste where the fuel source is produced from the earth.

This invention can also be employed with apparatus for generating electromagnetic radiation in very large amounts for propogation along artificially generated magnetic field lines which comprises providing a source of combustible fuel, means for burning the fuel essentially at its location of natural occurence to form a plasma, means for employing the plasma to generate electricity, means for converting electricity into the desired electromagnetic radiation, and means for generating the required artificial magnetic field line or lines.

In addition, the method of this invention can be practiced so that the first electromagnetic radiation is modulated to excite additional plasma waves within the plasma region while the plasma region is undergoing electron cyclotron resonance excitation. The method can also be employed for exploiting a naturally-occurring underground fuel source by converting the fuel source to electricity at the site where the fuel source occurs, converting the electricity to at least one electromagnetic radiation wave of known frequency, generating at least one artificial magnetic field line, transmitting the at least one electromagnetic radiation wave into the earth's atmosphere along the artificial magnetic field line to an elevation where electron cyclotron resonance takes place at the frequency of the at least one electromagnetic radiation wave. Further, the frequency of the at least one electromagnetic radiation wave can be varied as desired, both linearly and nonlinearly.

Reasonable variations and modifications are possible within the scope of this disclosure without departing from the spirit and scope of this invention.

What is claimed is:

1. A method of creating an artificial electron cyclotron resonance heating region of plasma at about 50 km above the earth's surface in which the collision rate of the electrons in said plasma is greater than the cyclotron frequency of said electrons, said method comprising:

establishing a first artificial magnetic field having a plurality of artificial field lines which extend from the surface of the earth through said region of plasma by positioning a circular loop of an electrical conductive cable at the surface of the earth so that the center of said loop will be colinear with the said artificial magnetic field lines;

passing an electric current through said loop to establish said artificial magnetic field having a magnetic field strength of about 10 fold greater than the field strength naturally occurring in said region; and transmitting first circularly polarized electromagnetic radiation having a frequency from 10 kilohertz to 30 gigahertz from the earth's surface, said transmitting being conducted essentially at the outset of transmission substantially parallel to and along said field lines of said artificial magnetic field, adjusting the frequency of said first radiation to a value which will excite electron cyclotron resonance at an initial altitude of about 50 km above the earth's surface, whereby in the region in which said electron cyclotron resonance takes place heating, further ionization, and movement of both charged and neutral particles is effected.

2. The method of claim 1 wherein said excitation of electron cyclotron resonance is continued to cause movement of said plasma region along said artificial magnetic field lines upward to an altitude which is higher than the altitude at which said excitation was initiated.

3. The method of claim 2 wherein said rising plasma region pulls with it a substantial portion of neutral particles of the atmosphere which exist in or near said plasma region.

4. The method of claim 1 wherein there is provided at least one separate source of second electromagnetic radiation, said second radiation having at least one frequency different from said first radiation, impinging said at least one second radiation on said plasma region while said plasma region is undergoing electron cyclotron resonance excitation caused by said first radiation.

5. The method of claim 4 wherein said second radiation has a frequency which is absorbed by said plasma region.

6. The method of claim 1 wherein said first electromagnetic radiation is right hand circularly polarized in the northern hemisphere and left hand circularly polarized in the southern hemisphere.

7. The method of claim 4 wherein said loop is positioned at an angle with respect to the normal horizontal plane at the earth's surface whereby said artificial magnetic force lines will extend outwardly from the earth's surface at an angle with respect to a normally occurring earth's magnetic field line.

8. The method of claim 7 wherein the radius of said loop is approximately equal to the altitude of said region.

9. The method of claim 8 wherein said region is at an altitude of about 35 kilometers.

10. The method of claim 9 wherein said cable comprises a 1 meter diameter, superconductive cable positioned in a circular loop which, in turn, has a radius of 35 kilometers and wherein said amperage is substantially about $5\times10^8$ amperes.

11. The method of claim 5 including:

establishing a second artificial field at a point on the earth's surface at a point spaced from said first artificial magnetic field;

establishing a second plasma region along the artificial field lines of said second artificial magnetic field at an altitude substantially the same as the altitude of said plasma region of said first magnetic field; and propogating said plasma waves between said first and second plasma regions.

* * * * *